US010301151B2

(12) United States Patent
Martin

(10) Patent No.: US 10,301,151 B2
(45) Date of Patent: May 28, 2019

(54) TRACTION SHEAVE FOR ELEVATOR SYSTEM

(71) Applicant: OTIS ELEVATOR COMPANY, Farmington, CT (US)

(72) Inventor: Kyle B. Martin, West Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 182 days.

(21) Appl. No.: 14/777,073

(22) PCT Filed: Mar. 15, 2013

(86) PCT No.: PCT/US2013/032194
§ 371 (c)(1),
(2) Date: Sep. 15, 2015

(87) PCT Pub. No.: WO2014/142987
PCT Pub. Date: Sep. 18, 2014

(65) Prior Publication Data

US 2016/0039640 A1 Feb. 11, 2016

(51) Int. Cl.
*B66B 9/00* (2006.01)
*B66B 11/08* (2006.01)
*B66B 15/04* (2006.01)

(52) U.S. Cl.
CPC ..... *B66B 15/04* (2013.01); *B66B 9/00* (2013.01); *B66B 11/08* (2013.01)

(58) Field of Classification Search
CPC ..... B66B 11/08; B66B 15/04
See application file for complete search history.

(56) References Cited

U.S. PATENT DOCUMENTS 1,944,426 A * 1/1934 Greening ..... F16H 55/50 474/178
3,010,332 A * 11/1961 Skates ..... B65G 23/04 474/184

(Continued)

FOREIGN PATENT DOCUMENTS

CH 77282 * 10/1917
CN 201228189 Y 4/2009

(Continued)

OTHER PUBLICATIONS

WO2013010878 English Translation.*

(Continued)

*Primary Examiner* — Minh Truong
(74) *Attorney, Agent, or Firm* — Cantor Colburn LLP

(57) ABSTRACT

A traction sheave for an elevator system includes an outer sheave surface having a distance from a sheave axis that varies along a width of the traction sheave. The outer sheave surface includes a first portion having a first coefficient of friction and one or more second portions having a second coefficient of friction less than the first coefficient of friction. An elevator system includes an elevator car, a motor and a traction sheave operably connected to the motor to drive rotation of the traction sheave. The traction sheave includes an outer sheave surface having a distance from a sheave axis that varies along a width of the traction sheave. The outer surface includes a first portion having a first coefficient of friction and one or more second portions having a second coefficient of friction less than the first coefficient of friction.

12 Claims, 6 Drawing Sheets

(56) References Cited

U.S. PATENT DOCUMENTS 3,140,621 A * 7/1964 Stone ..... F16H 55/36 198/835
3,142,192 A * 7/1964 Edberg ..... F16C 13/00 474/186
3,288,338 A * 11/1966 Morrow ..... B65G 39/071 226/193
3,522,643 A * 8/1970 Winkler ..... B21B 39/008 492/49
4,947,533 A * 8/1990 Taniguchi ..... B23B 5/46 29/894
5,346,438 A * 9/1994 Gerstenberger ..... F16D 1/068 474/151
6,371,448 B1 * 4/2002 De Angelis ..... B66B 15/04 254/374
6,635,000 B2 * 10/2003 Meindl ..... B61B 12/02 492/39
7,341,533 B2 * 3/2008 Wang ..... F16H 57/021 427/449
7,958,635 B2 * 6/2011 Yoshida ..... B24B 39/04 29/892
2002/0092285 A1 7/2002 Aulanko et al.
2003/0025109 A1 2/2003 Baranda et al.
2004/0256180 A1 * 12/2004 Eichhorn ..... B66B 15/04 187/254
2007/0062762 A1 * 3/2007 Ach ..... B66B 7/062 187/266
2007/0252121 A1 * 11/2007 Prasad ..... B66B 15/04 254/393
2010/0133046 A1 * 6/2010 Allwardt ..... B66B 7/08 187/251
2010/0236869 A1 9/2010 Fargo et al.
2011/0114908 A1 * 5/2011 Fargo ..... B66B 15/04 254/390
2012/0318615 A1 * 12/2012 Aulanko ..... B66B 15/04 187/254
2014/0008153 A1 1/2014 Fargo et al.
2016/0304321 A1 * 10/2016 Guilani ..... B66B 15/04

FOREIGN PATENT DOCUMENTS

JP 8239132 A 9/1996
JP H08239132 A 9/1996
JP 2004131229 A 4/2004
KR 2019980017225 9/1998
WO 2013010878 A1 1/2013

OTHER PUBLICATIONS

CH77282 English Translation.*
Notification of Transmittal of the International Search Report and the Written Opinion of the International Searching Authority; PCT/US2013/032194; Korean Intellectual Property Office; dated Dec. 17, 2013; ISR 5 pages; WO 6 pages.
Supplementary European Search Report and Communication; Application No. 13878064.8-1705/2969876; dated Nov. 2, 2016; 6 pages.
Chinese Office Action issued in CN Application No. 201380076576.X, dated Sep. 12, 2017, 12 Pages.

* cited by examiner

TRACTION SHEAVE FOR ELEVATOR SYSTEM

BACKGROUND

The subject matter disclosed herein relates to elevator systems driven by coated steel belts. More specifically, the subject disclosure relates sheave configurations from elevator systems driven by coated steel belts.

Elevator systems utilize coated steel belts operably connected to an elevator car, and driven by a motor to propel the elevator car along a hoistway. Coated steel belts in particular include a plurality of wires located at least partially within a jacket material. The plurality of wires is often arranged into one or more strands and the strands are then arranged into one or more cords. In an exemplary belt construction, a plurality of cords is typically arranged equally spaced within a jacket in a longitudinal direction.

The motor drives a sheave, in this case a traction sheave, over which the coated steel belt is routed. The belt gains traction at the traction sheave, such that rotation of the traction sheave consequently drives movement of the elevator car. A typical sheave includes a spherical crown on its drive surface to aid the belt in tracking toward a center of the sheave, even when the belt is slightly misaligned. The crown, however, tends to degrade performance of the belt by creating nonuniform contact pressure between the belt and sheave along a width of the sheave. Contact pressure peaks at the center of the belt, resulting in reduced life of the belt relative to a belt subjected to uniform contact pressure.

In addition, because of the high stiffness of the cords, the cords all tend to move at the same speed. The speed of the sheave surface, on the other hand, is directly proportional to a distance between a sheave centerline and an outer surface of the sheave. Because of the crown, the center of the sheave travels at a higher circumferential speed than either end of the sheave. Thus, there are locations along the sheave where the sheave rotational speed will vary from the belt speed, resulting in localized slipping of the belt relative to the sheave, resulting in belt wear.

BRIEF DESCRIPTION

In one embodiment, a traction sheave for an elevator system includes an outer sheave surface having a distance from a sheave axis that varies along a width of the traction sheave. The outer sheave surface includes a first portion having a first coefficient of friction and one or more second portions having a second coefficient of friction less than the first coefficient of friction.

In this or other embodiments, the first portion is positioned at a center area of the outer sheave surface relative to the width of the traction sheave.

In this or other embodiments, the first portion comprises about ⅓ of the width of the traction sheave.

In this or other embodiments, the first coefficient of friction of the first portion is defined by an abrasive blast applied to the first portion.

In this or other embodiments, the second coefficient of friction of the one or more second portions is defined by masking the one or more second portions during the abrasive blast operation.

In this or other embodiments, the first coefficient of friction of the first portion is defined by a coating applied to the first portion.

In this or other embodiments, the one or more second portions are two second portions, each second portion extending from a sheave end toward a center of the sheave.

In this or other embodiments, each second portion includes about ⅓ of the width of the traction sheave.

In this or other embodiments, the second coefficient of friction of the one or more second portions is defined by a coating applied to the one or more second portions.

In this or other embodiments, the first coefficient of friction is defined by masking the first portion while applying the coating to the one or more second portions.

In this or other embodiments, the coating is a Teflon nickel coating.

In this or other embodiments, the outer sheave surface has a spherical crown.

In this or other embodiments, a difference between the first coefficient of friction and the second coefficient of friction is defined by a difference in materials of the first portion and the one or more second portions.

In another embodiment, an elevator system includes an elevator car, a motor and a traction sheave operably connected to the motor to drive rotation of the traction sheave. The traction sheave includes an outer sheave surface having a distance from a sheave axis that varies along a width of the traction sheave. The outer surface includes a first portion having a first coefficient of friction and one or more second portions having a second coefficient of friction less than the first coefficient of friction. A belt is operably connected to the elevator car and in frictional contact with the outer sheave surface such that rotation of the traction sheave urges movement of the elevator car.

The detailed description explains the invention, together with advantages and features, by way of examples with reference to the drawings.

DETAILED DESCRIPTION

Figure 1A:
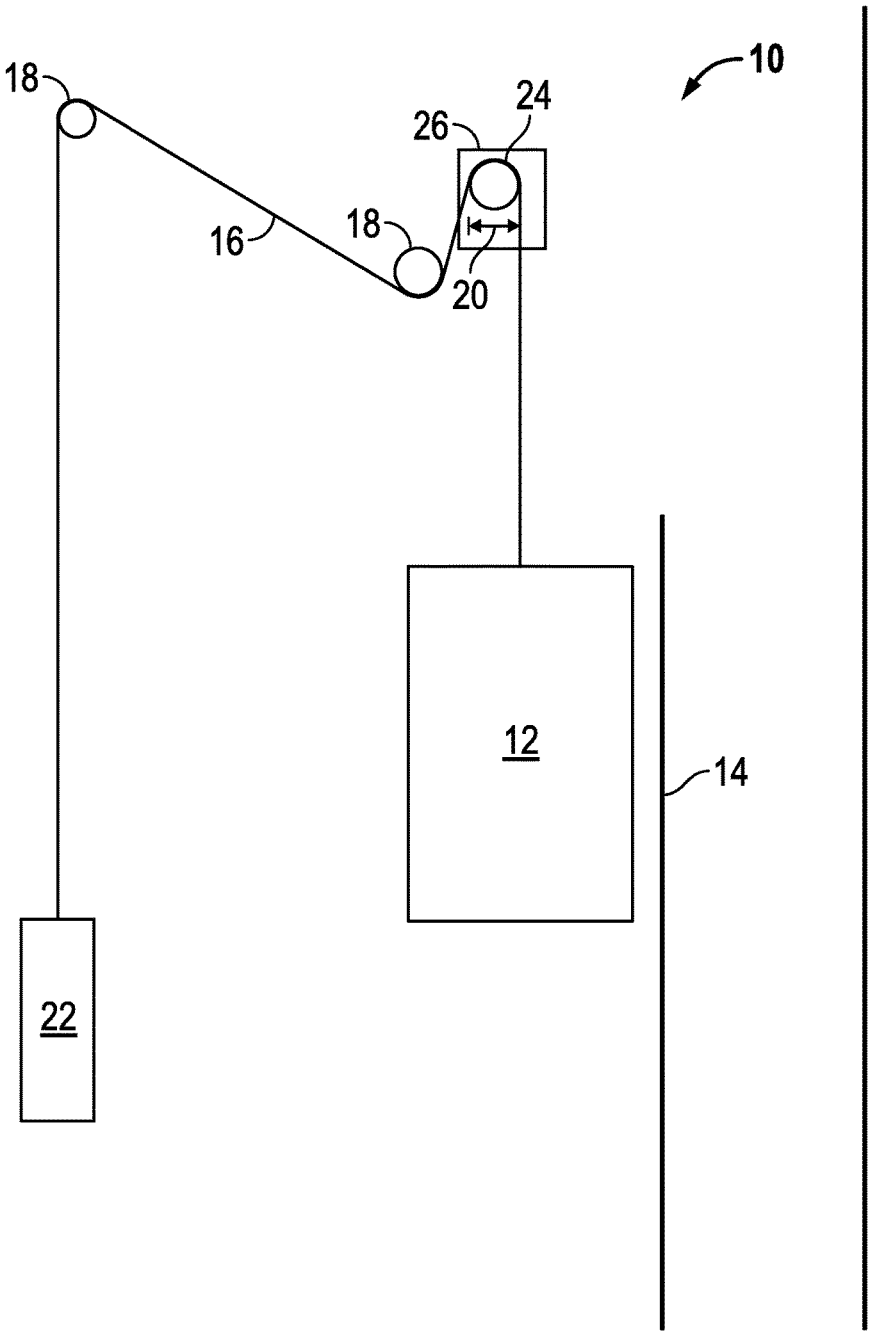
FIG. 1A is a schematic of an exemplary elevator system having a 1:1 roping arrangement.
Figure 1B:
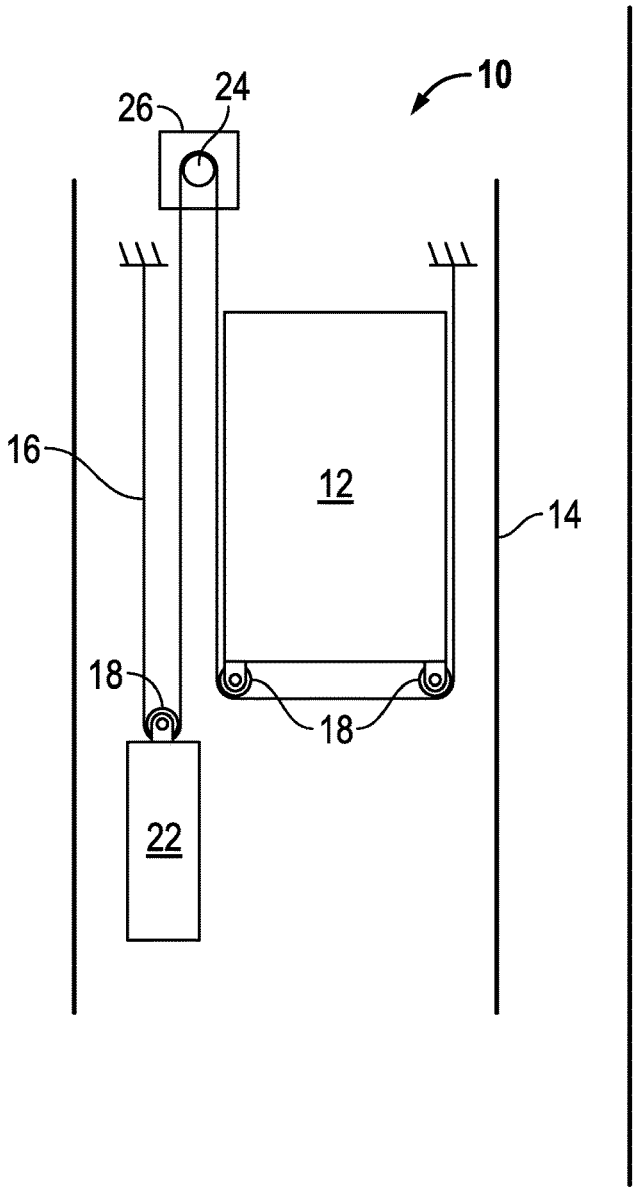
FIG. 1B is a schematic of another exemplary elevator system having a different roping arrangement.
Figure 1C:
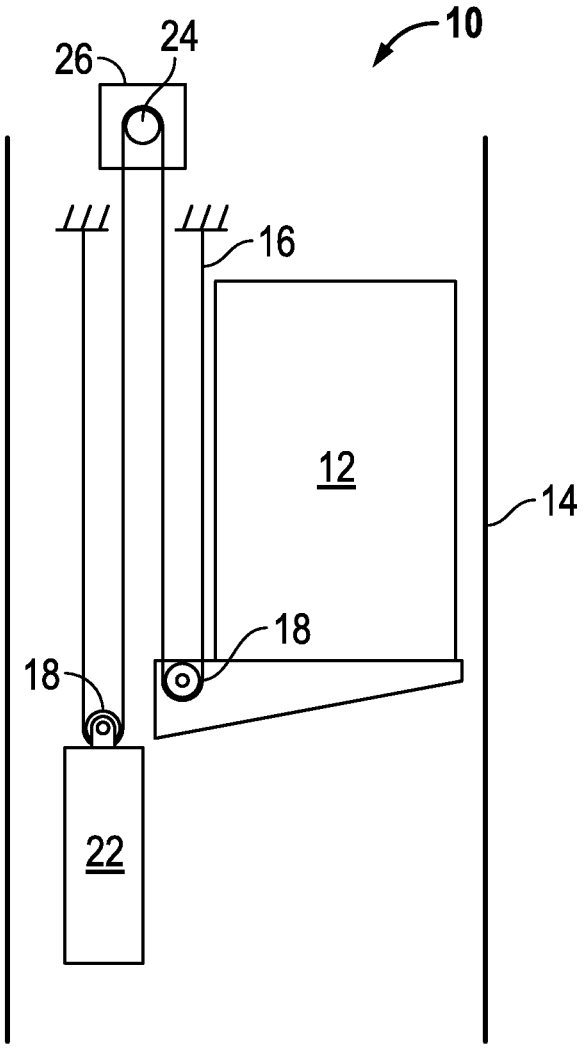
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation. It is to be appreciated that while the embodiments herein are described as applied to coated steel belts, it is to be appreciated that the disclosure herein may similarly be applied to steel ropes, either coated or uncoated.

The sheaves 18 each have a diameter 20, which may be the same or different than the diameters of the other sheaves 18 in the elevator system 10. At least one of the sheaves 18 could be a traction sheave 24. The traction sheave 24 is driven by a machine 26. Movement of the traction sheave 24 by the machine 26 drives, moves and/or propels (through traction) the one or more belts 16 that are routed around the traction sheave 24.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIGS. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room). The number of sheaves 18 used in the arrangement determines the specific roping ratio (e.g., the 2:1 roping ratio shown in FIGS. 1B and 1C or a different ratio). FIG. 1C also provides a cantilevered type elevator. The present invention could be used on elevator systems other than the exemplary types shown in FIGS. 1A, 1B and 1C.

Figure 2:
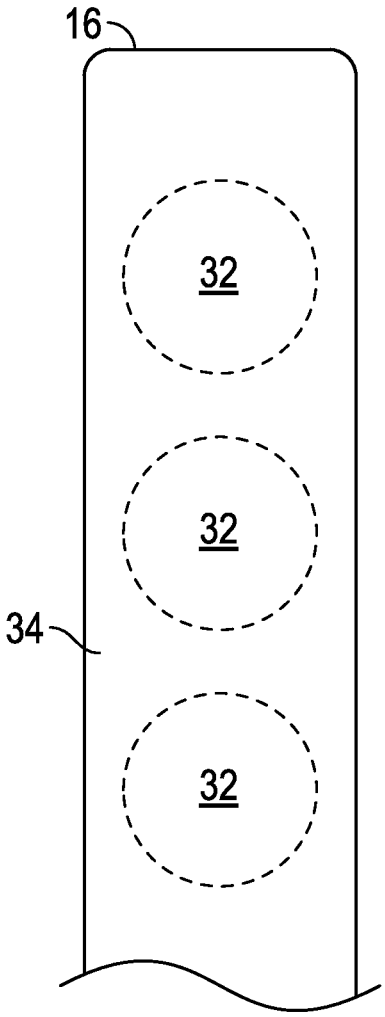
FIG. 2 is a cross-sectional view of an elevator belt.
Figure 3:
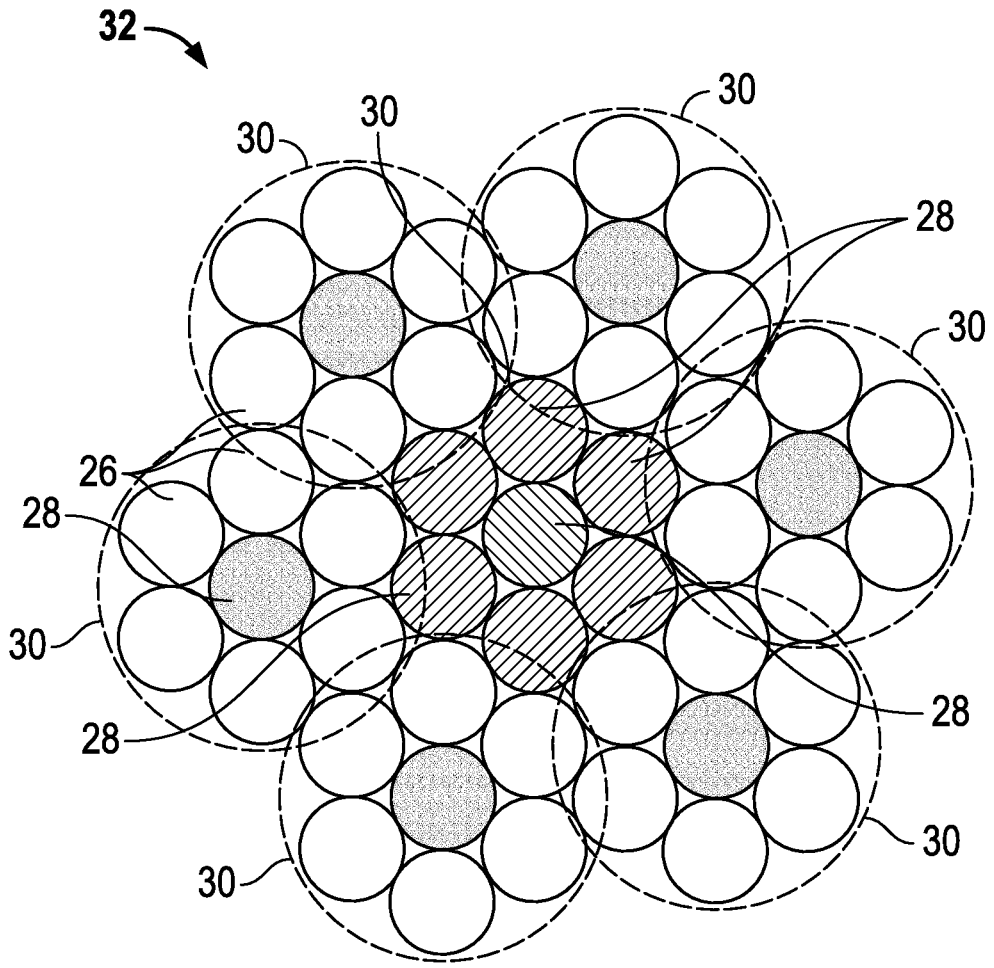
FIG. 3 is a cross-sectional view of a cord or rope.

FIG. 2 provides a schematic of a belt construction or design. Each belt 16 is constructed of a plurality of wires 28 (e.g. twisted into one or more strands 30 and/or cords 32 as shown in FIG. 3) in a jacket 34. As seen in FIG. 2, the belt 16 has an aspect ratio greater than one (i.e. belt width is greater than belt thickness). The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12. The jacket 34 could be any suitable material, including a single material, multiple materials, two or more layers using the same or dissimilar materials, and/or a film. In one arrangement, the jacket 34 could be a polymer, such as an elastomer, applied to the cords 32 using, for example, an extrusion or a mold wheel process. In another arrangement, the jacket 34 could be a woven fabric that engages and/or integrates the cords 32. As an additional arrangement, the jacket 34 could be one or more of the previously mentioned alternatives in combination.

The jacket 34 can substantially retain the cords 32 therein. The phrase substantially retain means that the jacket 34 has sufficient engagement with the cords 32 to transfer torque from the machine 26 through the jacket 34 to the cords 32 to drive movement of the elevator car 12. The jacket 34 could completely envelop the cords 32 (such as shown in FIG. 2), substantially envelop the cords 24, or at least partially envelop the cords 32.

Figure 4:
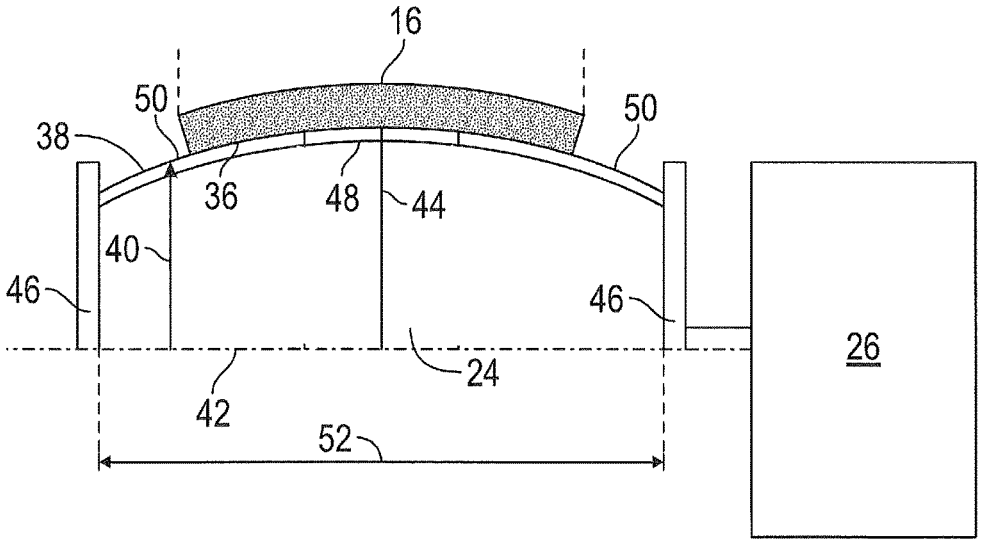
FIG. 4 is a cross-sectional view of an embodiment of a traction sheave for an elevator system.

Referring to FIG. 4, the traction sheave 24 is driven by the machine 26, and drives motion of the belt 16 via traction between a belt outer surface 36 and a sheave outer surface 38. The sheave outer surface 38 includes a crown, in some embodiments a spherical crown, such that a sheave radius 40 from a sheave axis 42 to the sheave outer surface 38 is greater at a sheave center 44 of the traction sheave 24 than at either sheave end 46 of the traction sheave 24. The crown configuration aids the belt 16 in being substantially centered on the sheave outer surface 38 between sheave ends 46. As stated above, however, prior art traction sheaves with crowns cause uneven belt contact pressure and relative motion between portions of the belt and the traction sheave, thereby causing premature wear of the belt.

The traction sheave 24 is uniquely configured to address the problems noted with prior art traction sheaves. The traction sheave 24 includes a high traction zone 48 and one or more low traction zones 50. The high traction zone 48 is located, for example, around the sheave center 44 of the traction sheave 24, and in some embodiments includes about a center ⅓ of the sheave outer surface 38. The high traction zone 48 is treated by abrasive blasting or other surface treatment or coating to provide a high traction surface to effectively transfer torque from the traction sheave 24 to the belt 16. The low traction zones 50 are located, for example, outboard of the high traction zone 48 and extend to the sheave ends 46, and in some embodiments include about the outer ⅓ portions of the sheave outer surface 38. The low traction zones 50 are characterized by having a lower coefficient of friction than the high traction sheave 48. The lower coefficient of friction in the low traction zones 50 is achieved by, in some embodiments, applying a reduced-friction coating to the low traction zones 50, for example, a Teflon nickel coating, an electroless nickel coating, a thin dense chrome coating, or a low friction plasma coating. In other embodiments, the lower coefficient of friction in the low traction zones 50 is achieved by masking the low traction zones 50 during the abrasive blast operation on the high traction zone 48. It is to be appreciated that lower coefficient of friction in the low traction zones 50 may further be achieved via other means, for example, by the use of different materials to form the low traction zones 50, relative to the high traction sheave 48.

In some embodiments, the low friction zones 50 extend from each sheave end 46 toward the sheave center 44, with each low friction zone 50 covering about ⅓ of a sheave width 52. The smoother surface and lower friction of the low traction zones 50 reduces wear of the belt 16 as the belt 16 moves relative to the traction sheave 24 while the high traction zone 48 provides the traction necessary to drive the belt 16.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator system comprising:

an elevator car;

a motor;

a traction sheave operably connected to the motor to drive rotation of the traction sheave, the traction sheave including:

an outer sheave surface having a distance from a sheave axis that varies along a width of the traction sheave, the outer surface including:

a first portion having a first coefficient of friction; and two second portions having a second coefficient of friction less than the first coefficient of friction; and a belt operably connected to the elevator car, the belt in frictional contact with the outer sheave surface such that rotation of the traction sheave urges movement of the elevator car;

wherein the first portion is positioned at a center area of the outer sheave surface relative to the width of the traction sheave;

wherein the first portion defines about ⅓ of the width of the traction sheave;

wherein each of the second portions defines about ⅓ of the width of the traction sheave; and wherein the outer sheave surface has a spherical crown.

2. The elevator system of claim 1, wherein the first coefficient of friction of the first portion is defined by an abrasive blast applied to the first portion.

3. The elevator system of claim 2, wherein the second coefficient of friction of the one or more second portions is defined by masking the one or more second portions during the abrasive blast operation.

4. The elevator system of claim 1, wherein the first coefficient of friction of the first portion is defined by a coating applied to the first portion.

5. The elevator system of claim 1, wherein the second coefficient of friction of the one or more second portions is defined by a coating applied to the one or more second portions.

6. A traction sheave for an elevator system comprising:

an outer sheave surface having a distance from a sheave axis that varies along a width of the traction sheave, the outer surface including:

a first portion having a first coefficient of friction; and two second portions having a second coefficient of friction less than the first coefficient of friction;

wherein the first portion is positioned at a center area of the outer sheave surface relative to the width of the traction sheave;

wherein the first portion defines about ⅓ of the width of the traction sheave;

wherein each of the second portions defines about ⅓ of the width of the traction sheave; and wherein the outer sheave surface has a spherical crown.

7. The traction sheave of claim 6, wherein the first coefficient of friction of the first portion is defined by an abrasive blast applied to the first portion.

8. The traction sheave of claim 7, wherein the second coefficient of friction of the one or more second portions is defined by masking the one or more second portions during the abrasive blast operation.

9. The traction sheave of claim 6, wherein the first coefficient of friction of the first portion is defined by a coating applied to the first portion.

10. The traction sheave of claim 6, wherein the one or more second portions are two second portions, each second portion extending from a sheave end toward a center of the sheave.

11. The traction sheave of claim 6, wherein the second coefficient of friction of the one or more second portions is defined by a coating applied to the one or more second portions.

12. The traction sheave of claim 6 wherein a difference between the first coefficient of friction and the second coefficient of friction is defined by a difference in materials of the first portion and the one or more second portions.

* * * * *